US009787009B2

(12) United States Patent
Tsai et al.

(10) Patent No.: US 9,787,009 B2
(45) Date of Patent: Oct. 10, 2017

(54) RECEPTACLE CONNECTOR HAVING AN INSULATING TONGUE WITH A COMBINING AREA FOR ACCOMMODATING COMBINING PORTIONS OF A PLURALITY OF CONTACTS

(71) Applicant: ADVANCED-CONNECTEK INC., New Taipei (TW)

(72) Inventors: Yu-Lun Tsai, New Taipei (TW); Pin-Yuan Hou, New Taipei (TW); Chung-Fu Liao, New Taipei (TW); Long Fei Chen, New Taipei (TW); Dong Xiang, New Taipei (TW)

(73) Assignee: ADVANCED-CONNECTEK INC., New Taipei (TW)

( * ) Notice: Subject to any disclaimer, the term of this patent is extended or adjusted under 35 U.S.C. 154(b) by 0 days.

(21) Appl. No.: 15/227,975

(22) Filed: Aug. 4, 2016

(65) Prior Publication Data

US 2017/0040748 A1 Feb. 9, 2017

(30) Foreign Application Priority Data

Aug. 7, 2015 (CN) ..... 2015 1 0479860

(51) Int. Cl.
*H01R 13/648* (2006.01)
*H01R 12/57* (2011.01)
(Continued)

(52) U.S. Cl.
CPC ..... *H01R 12/57* (2013.01); *H01R 12/707* (2013.01); *H01R 13/405* (2013.01);
(Continued)

(58) Field of Classification Search
CPC .... H01R 13/41; H01R 13/424; H01R 13/502; H01R 13/648; H01R 13/658;
(Continued)

(56) References Cited

U.S. PATENT DOCUMENTS 8,079,880 B2 * 12/2011 Lin ..... H01R 13/631 439/668
8,167,631 B2 * 5/2012 Ito ..... H01R 24/38 439/108

(Continued)

*Primary Examiner* — Chandrika Prasad
(74) *Attorney, Agent, or Firm* — Winston Hsu

(57) ABSTRACT

An electrical receptacle connector includes a shell, a first insulator, a second insulator and a blanking contact. The first insulator is disposed in the shell. The first insulator has a first insulator front end and a first insulator rear end. The second insulator is disposed in the shell and installed on the first insulator. The second insulator has a combining area. The blanking contact includes a fixing portion, a soldering portion, a contact portion and a combining portion. The fixing portion is combined with the first insulator. The soldering portion protrudes from the fixing portion toward the first insulator rear end and stretches out of the first insulator rear end. The contact portion protrudes from the fixing portion toward the first insulator front end and stretches out of the first insulator rear end. The combining portion protrudes from the contacting portion and inserts into the combining area.

15 Claims, 10 Drawing Sheets

(51) Int. Cl.

| | |
|---|---|
| ***H01R 13/6585*** | (2011.01) |
| ***H01R 12/70*** | (2011.01) |
| ***H01R 13/405*** | (2006.01) |
| ***H01R 13/6581*** | (2011.01) |
| ***H01R 13/6594*** | (2011.01) |
| ***H01R 24/60*** | (2011.01) |

(52) U.S. Cl.
CPC ..... *H01R 13/6581* (2013.01); *H01R 13/6585* (2013.01); *H01R 13/6594* (2013.01); *H01R 24/60* (2013.01)

(58) Field of Classification Search
CPC H01R 13/6585; H01R 13/6586; H01R 12/57; H01R 12/707; H01R 13/40; H01R 13/405; H01R 13/6581; H01R 13/6594; H01R 24/60; H01R 24/64
See application file for complete search history.

(56) References Cited

U.S. PATENT DOCUMENTS

| | | | | |
|---|---|---|---|---|
| 8,449,335 | B2 * | 5/2013 | Briant | H01R 12/7005 439/637 |
| 8,465,299 | B2 * | 6/2013 | Ho | H01R 13/506 439/607.05 |
| 8,808,029 | B2 * | 8/2014 | Castillo | H01R 13/6585 439/607.05 |
| 9,362,680 | B2 * | 6/2016 | Kao | H01R 13/6583 |
| 9,496,657 | B1 * | 11/2016 | Chang | H01R 13/6471 |
| 2009/0117784 | A1 * | 5/2009 | Wu | H01R 24/62 439/660 |
| 2014/0024257 | A1 * | 1/2014 | Castillo | H01R 13/6585 439/607.05 |
| 2015/0380870 | A1 * | 12/2015 | Kao | H01R 13/6583 439/607.01 |

* cited by examiner

RECEPTACLE CONNECTOR HAVING AN INSULATING TONGUE WITH A COMBINING AREA FOR ACCOMMODATING COMBINING PORTIONS OF A PLURALITY OF CONTACTS

BACKGROUND OF THE INVENTION

1. Field of the Invention

The present invention relates to a receptacle connector, and more particularly, to a receptacle connector with capability of prevention of deformation of contacts during mating process.

2. Description of the Prior Art

With the development of computer and peripheral equipment industry, a Universal Serial Bus (USB) interface has become one of important interfaces for communication and data transmission between a computer and peripheral equipment. As technology advances, high speed transmission becomes a trend, and there is a need to develop an electrical connector with high speed transmission. Thus, a new specification of the Universal Serial Bus interface, i.e., Universal Serial Bus (USB) 3.0, is developed. However, front ends of contacts of the electrical connector with specification in accordance with USB 3.0, are easily deformed during mating process. Therefore, it becomes an important issue how to design a receptacle connector with capability of prevention of deformation of contacts during mating process in the industry.

SUMMARY OF THE INVENTION

The present invention provides a receptacle connector with capability of prevention of deformation of contacts during mating process for solving above drawbacks.

In order to achieve the aforementioned objective, a receptacle connector includes a shell, a first insulator, a second insulator a first conducting member, a shielding member, a second conducting member and at least one first blanking contact. The first insulator is disposed inside the shell. The first insulator has a first insulator outer surface, a first insulator inner surface, a first insulator front end and a first insulator rear end. The second insulator is disposed inside the shell and assembled with the first insulator. The second insulator has a second insulator outer surface and a second insulator inner surface. The first insulator inner surface abuts against the second insulator inner surface. At least one second combining area is formed on the second insulator surface. The first conducting member is disposed on the first insulator outer surface. The shielding member is combined with the second insulator. The second conducting member is combined with the second insulator outer surface. The at least one blanking contact includes a first fixing portion, a first soldering portion, a first contact portion and a first combining portion. The first fixing portion is combined with the first insulator. The first soldering portion protrudes from the first fixing portion toward the first insulator rear end and stretches out of the first insulator rear end. The first contact portion protrudes from the first fixing portion toward the first insulator front end and stretches out of the first insulator front end. The first combining portion protrudes from the first contact portion and is inserted into the at least one combining area.

In summary, the present invention utilizes the first combining portion of the first blanking contact for being inserted into the second insulator inner surface, and the present invention further utilizes the second combining portion of the second blanking contact for being inserted into the second insulator outer surface. Accordingly, the first combining portion and the second combining portion firmly hold the wall body of the second insulator, so as to prevent the first blanking contact 21 from deformation during mating process.

These and other objectives of the present invention will no doubt become obvious to those of ordinary skill in the art after reading the following detailed description of the preferred embodiment that is illustrated in the various figures and drawings.

DETAILED DESCRIPTION

In the following detailed description of the preferred embodiments, reference is made to the accompanying drawings which form a part hereof, and in which is shown by way of illustration specific embodiments in which the invention may be practiced. In this regard, directional terminology, such as "top," "bottom," "front," "back," etc., is used with reference to the orientation of the Figure(s) being described. The components of the present invention can be positioned in a number of different orientations. As such, the directional terminology is used for purposes of illustration and is in no way limiting. Accordingly, the drawings and descriptions will be regarded as illustrative in nature and not as restrictive.

Figure 1:
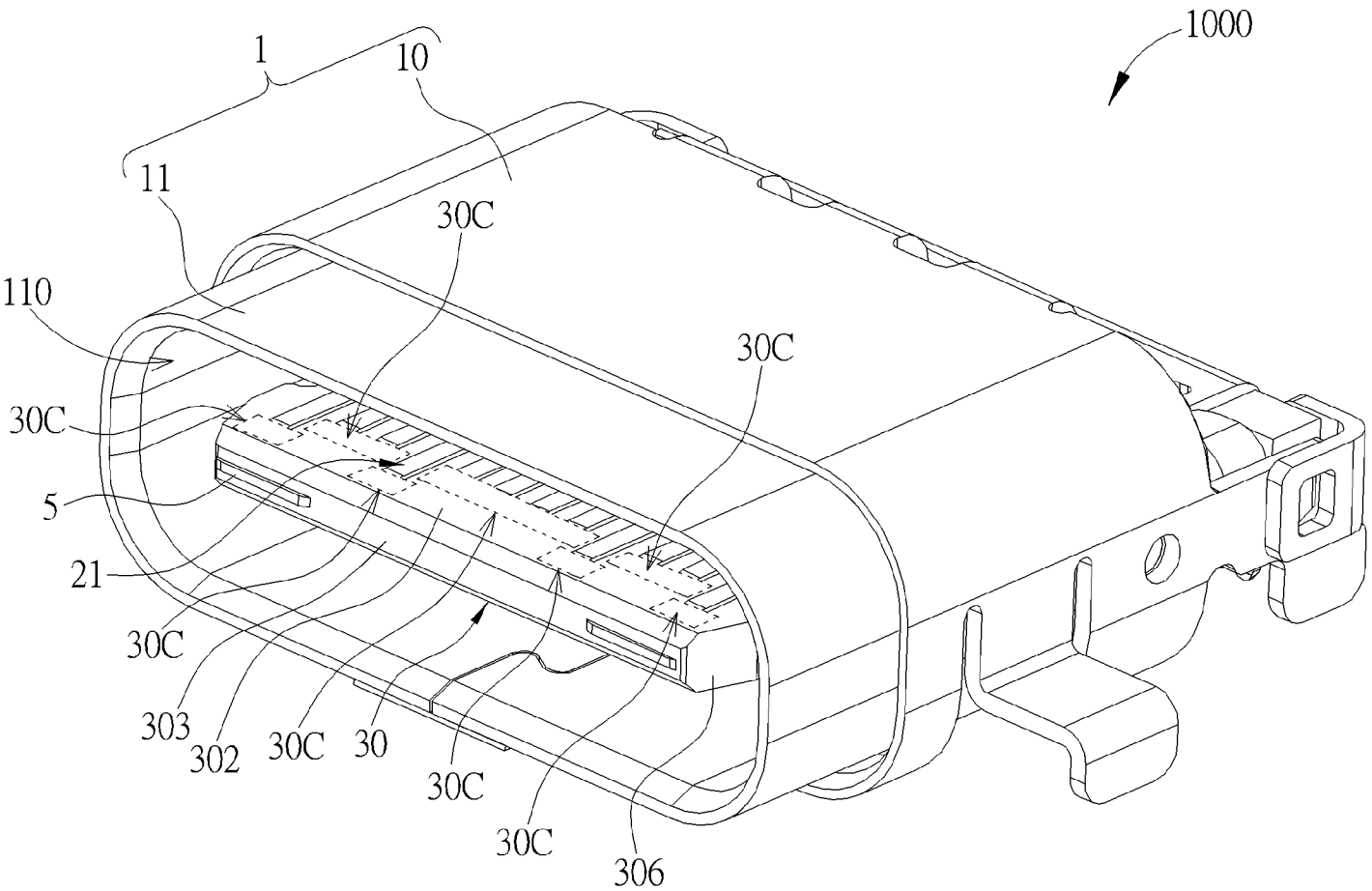
FIG. 1 is a schematic diagram of a receptacle connector according to an embodiment of the present invention.
Figure 2:
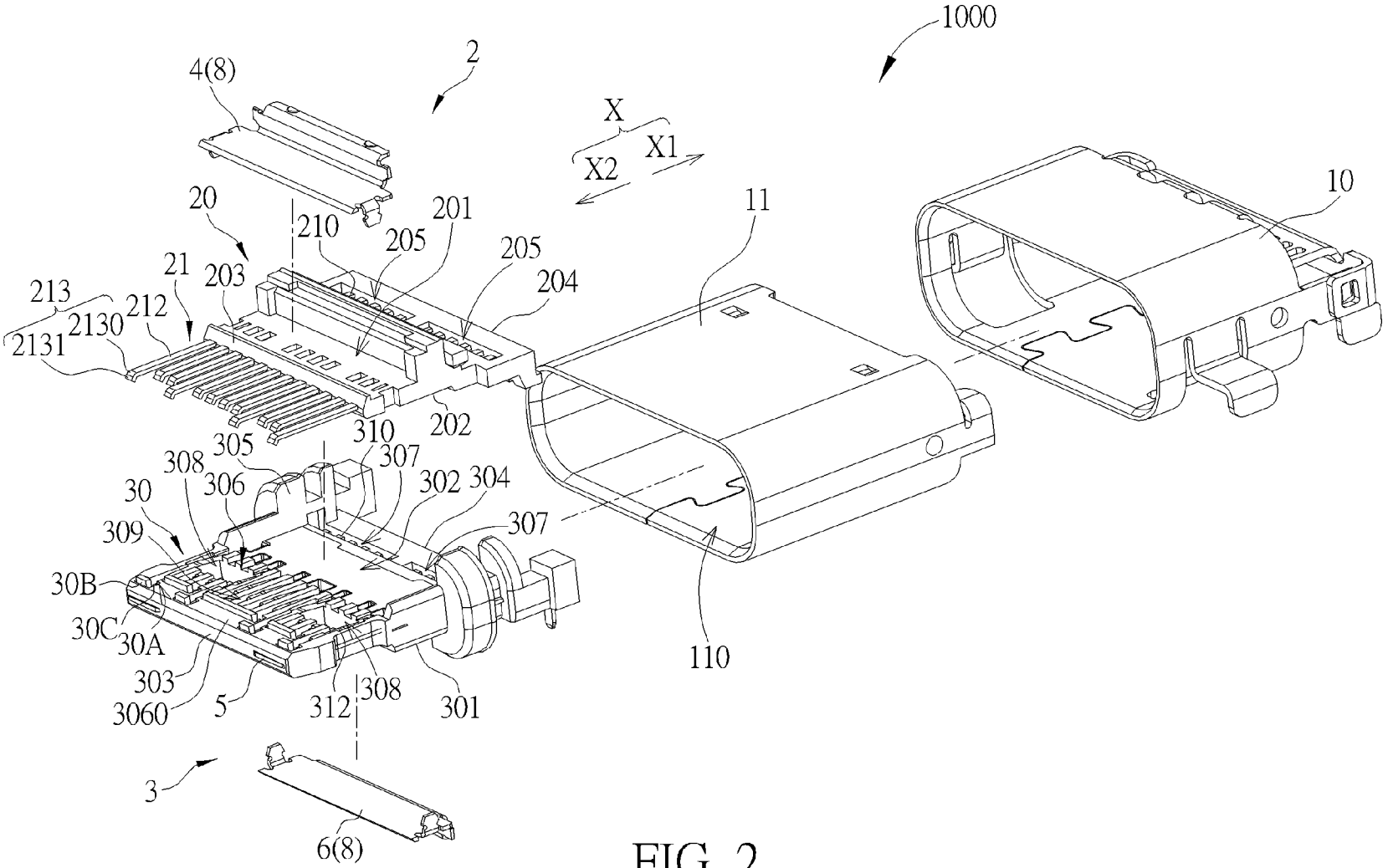
FIG. 2 and FIG. 3 are exploded diagrams of the receptacle connector in different views according to the embodiment of the present invention.
Figure 3:
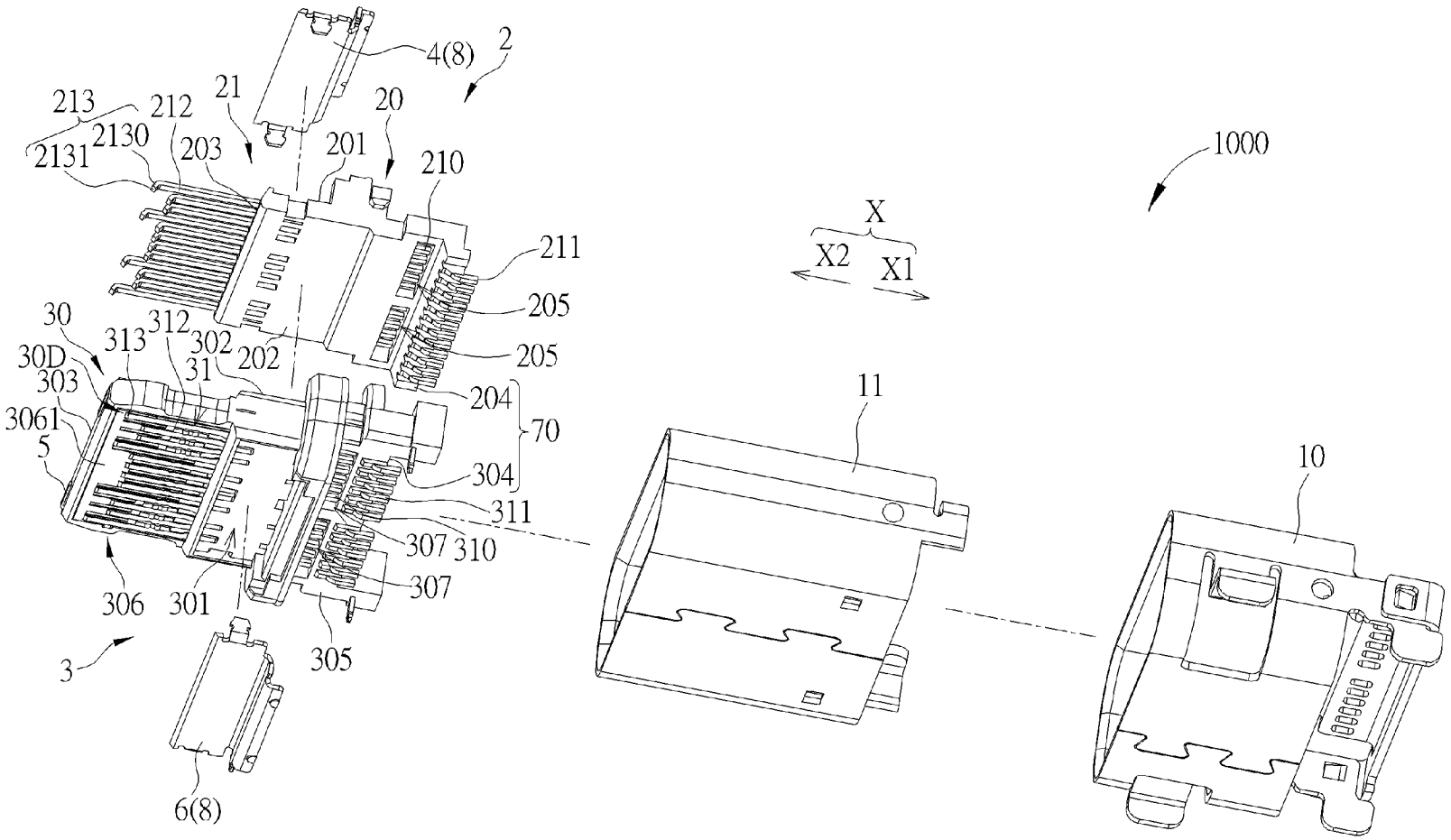

Please refer to FIG. 1 to FIG. 3. FIG. 1 is a schematic diagram of a receptacle connector 1000 according to an embodiment of the present invention. FIG. 2 and FIG. 3 are exploded diagrams of the receptacle connector 1000 in different views according to the embodiment of the present invention. As shown in FIG. 1 to FIG. 3, the receptacle connector 1000 includes a shell 1, a first contact module 2, a second contact module 3, a shielding member 5 and a conductive structure 8. The first contact module 2 includes a first insulator 20 and a first blanking contact set. The first blanking contact set has twelve first blanking contacts 21. The second contact module 3 includes a second insulator 30 and a second blanking contact set. The second blanking contact set has twelve second blanking contacts 31. In this embodiment, the conductive structure 8 includes a first conducting member 4 and a second conducting member 6.

Furthermore, the shell 1 includes a first shell portion 10 and a second shell portion 11. The first shell portion 10 is fixed on a circuit board (not shown in figures), and the second shell portion 11 is fixed on the first shell portion 10, wherein a containing space 110 is surrounded by the second shell portion 11. The containing space 110 is for containing the first insulator 10 and the second insulator 30, such that the first insulator 10 and the second insulator 30 are disposed inside the shell 1. Furthermore, the second insulator 30 is able to be assembled with the first insulator 10. For example, the second insulator 30 can be assembled with the first insulator 10 in an engaging manner or in a tight-fit manner, but the present invention is not limited thereto. For example, the first insulator 10 can be integrally formed with the second insulator 30 as well, and it depends on practical demands. When the second insulator 30 is assembled with the first insulator 10, the combination of the second insulator 30 and the first insulator 10 is an insulating base 7, i.e., the insulating base 7 of the present invention can include the first insulator 10 and the second insulator 30 assembled with the first insulator 10. The insulating base 7 has an insulating base rear end 70 and a tongue structure 306. The tongue structure 306 has a first surface 3060 and a second surface 3061.

In addition, the first insulator 10 has a first insulator outer surface 201, a first insulator inner surface 202, a first insulator front end 203 and a first insulator rear end 204. The second insulator 30 has a second insulator outer surface 301, a second insulator inner surface 302, a second insulator front end 303 and a second insulator rear end 304. The first conducting member 4 is disposed on the first insulator outer surface 201, i.e., the first conducting member 4 is disposed on the insulating base 7 and located next to the first surface 3060. The first insulator front end 203 and the first insulator rear end 204 can define a front-rear direction X of the receptacle connector 1000. When the second insulator 30 is assembled with the first insulator 10, the first insulator inner surface 202 abuts against the second insulator inner surface 302, and the first insulator rear end 204 and the second insulator rear end 304 cooperatively define the insulating base rear end 70, wherein the tongue structure 306 extends from the second insulator 30. The shielding member 5 is disposed in the tongue structure 306 of the second insulator 30, and the second conducting member 6 is combined with the second insulator outer surface 301, i.e., the second conducting member 6 is disposed on the insulating base 7 and located next to the second surface 3061.

In this embodiment, the receptacle connector 1000 is a receptacle connector with specification in accordance with Universal Serial Bus 3.0, USB 3.0, and the first blanking contact 21 and the second blanking contact 31 respectively include a signal contact, a grounding contact and a power contact of the USB 3.0 receptacle connector, wherein each of the first blanking contact set and the second blanking contact set can comprise at least two pairs of differential signal contacts, and the at least two pairs of differential signal contacts of the first blanking contact set are symmetrical to the at least two pairs of differential signal contacts of the second blanking contact set about the front-rear direction X of receptacle connector 1000 and coincides with the at least two pairs of differential signal contacts of the second blanking contact set after rotation by 180 degrees. In this embodiment, the first conducting member 4 and the second conducting member 6 are respectively an Electro Magnetic Interference spring, EMI spring, of the USB 3.0 receptacle connector, and the shielding member 5 is a shielding plate of the USB 3.0 receptacle connector. The EMI springs, i.e., the first conducting member 4 and the second conducting member 6, are disposed on outer area of a top side and a bottom side of the insulating base, i.e., the first insulator 10 and the second insulator 30 of the USB 3.0 receptacle connector, i.e., the receptacle connector 1000, and the shielding plate, i.e., the shielding member 5, is wrapped inside the insulating base of the USB 3.0 receptacle connector and located between contacts of the USB 3.0 receptacle connector.

As shown in FIG. 1 to FIG. 3, the first blanking contact 21 includes a first fixing portion 210, a first soldering portion 211 and a first contact portion 212. The first fixing portion 210 is combined with the first insulator 10. The first soldering portion 211 protrudes from the first fixing portion 210 toward the first insulator rear end 204, i.e., a rear direction X1 of the front-rear direction X of the receptacle connector 1000, and the first soldering portion 211 stretches out of the first insulator rear end 204. In other words, the first soldering portion 211 protrudes toward the insulating base rear end 70 and stretches out of the insulating base rear end 70, such that the first soldering portion 211 is exposed on the first insulator 10 for being soldered and fixed onto a circuit board (not shown in figures). The first contact portion 212 protrudes from the first fixing portion 210 toward the first insulator front end 203, i.e., a front direction X2 of the front-rear direction X of the receptacle connector 1000, and the first contact portion 212 stretches out of the first insulator front end 203. In other words, the first contact portion 212 protrudes from the first fixing portion 210 toward the tongue structure 306 of the second insulator 30 of the insulating base 7 and stretches out of the first surface 3060 of the tongue structure 306. In this embodiment, the first insulator 10 does not have a tongue structure. When the first insulator 10 is not yet assembled with the second insulator 30, the first contact portion 212 of the first blanking contact 21 stretches out of the first insulator 10 without structural supporting.

Furthermore, the second blanking contact 31 includes a second fixing portion 310, a second soldering portion 311 and a second contact portion 312. The second fixing portion 310 is combined with the second insulator 30. The second soldering portion 311 protrudes from the second fixing portion 310 toward the second insulator rear end 304 i.e., the rear direction X1 of the front-rear direction X of the receptacle connector 1000, and the second soldering portion 311 stretches out of the second insulator rear end 304. In other words, the second soldering portion 311 protrudes toward the insulating base rear end 70 and stretches out of the insulating base rear end 70, such that the second soldering portion 311 is exposed on the second insulator 30 for being soldered and fixed onto the circuit board. The second contact portion 312 protrudes from the first fixing portion 210 toward the second insulator front end 303, i.e., the front direction X2 of the front-rear direction X of the receptacle connector 1000. In other words, the second contact portion 312 protrudes from the first fixing portion 210 toward the tongue structure 306 of the second insulator 30 of the insulating base 7 and stretches out of the second surface 3061 of the tongue structure 306.

In this embodiment, the second insulator 30 includes a base 305, wherein the tongue structure 306 is extended and protrudes from the base 305. Two first through hole areas 307 and two second through hole areas 308 are formed on the second insulator 30. The first through hole areas 307 and the second through hole areas 308 are opened from the second insulator outer surface 301 to the second insulator inner surface 302 of the second insulator 30. The second fixing portion 310 of the second blanking contact 31 is disposed through the first through hole areas 307, such that a portion of the second fixing portion 310 is exposed on the second insulator outer surface 301 and the second insulator inner surface 302. The second contact portion 312 of the second blanking contact 31 is disposed through the second through hole areas 308, such that a portion of the second contact portion 312 is exposed on the second insulator outer surface 301 and the second insulator inner surface 302. Accordingly, the first through hole areas 307 and the second through hole areas 308 provides places for clamping, such that the second blanking contact 31 is fixed by molded parts during molding process. In such a manner, the second blanking contact 31 and the second insulator 30 can be integrally formed by insert molding, and the second fixing portion 310 of the second blanking contact 31 and the second contact portion 312 can respectively be combined with the base 305 of the second insulator 30 and the tongue structure 306.

As shown in FIG. 1 to FIG. 3, two hollow areas 205 are formed on the first insulator 10. The hollow areas 205 are opened from the first insulator outer surface 201 to the first insulator inner surface 202. The first fixing portion 210 of the first blanking contact 21 is disposed through the hollow areas 205, such that a portion of the first fixing portion 210 is exposed on the first insulator outer surface 201 and the first insulator inner surface 202. Accordingly, the hollow areas 205 can provide places for clamping, such that the first blanking contact 21 is fixed by molding parts during molding process. In such a manner, the first blanking contact 21 and the first insulator 10 can be integrally formed by insert molding, and the first fixing portion 210 of the first blanking contact 21 can be combined with the first insulator 10. In addition, since the first insulator 10 of the present invention does not have the tongue structure, the first contact portion 212 of the first blanking contact 21 is extended and protrudes from the first insulator 10 with structural supporting when the first fixing portion 210 is assembled with the first insulator 10, as shown in FIG. 2.

It should be noticed that amounts and disposal positions of the hollow areas 205, the first through hole areas 307 and the second through hole areas 308 of the present invention are not limited to those illustrated in figures in this embodiment. For example, there can be the only one hollow areas 205 formed on the first insulator 10, and there can be only one first through hole areas 307 and the only one second through hole areas 308 formed on the second insulator 30, i.e., structures that at least one hollow area 205 formed on the first insulator 10 and at least one first through hole area 307 and at least one second through hole area 308 formed on the second insulator 30 are within the scope of the present invention. As shown in FIG. 2 and FIG. 3, a plurality of first assembling slots 309 and a plurality of the second assembling slots 301J are respectively formed on the first surface 3060 and the second surface 3061 of the tongue structure 306. Each of the second contact portions 312 of the second blanking contacts 31 is assembled in the corresponding second assembling slots 30D. When the first contact module 2 is assembled with the second contact module 3, the first insulator inner surface 202 of the first insulator 10 abuts against the second insulator inner surface 302 of the second insulator 30, and each of the first contact portions 212 of the first blanking contacts 21 is assembled in the corresponding first assembling slot 309.

Figure 4:
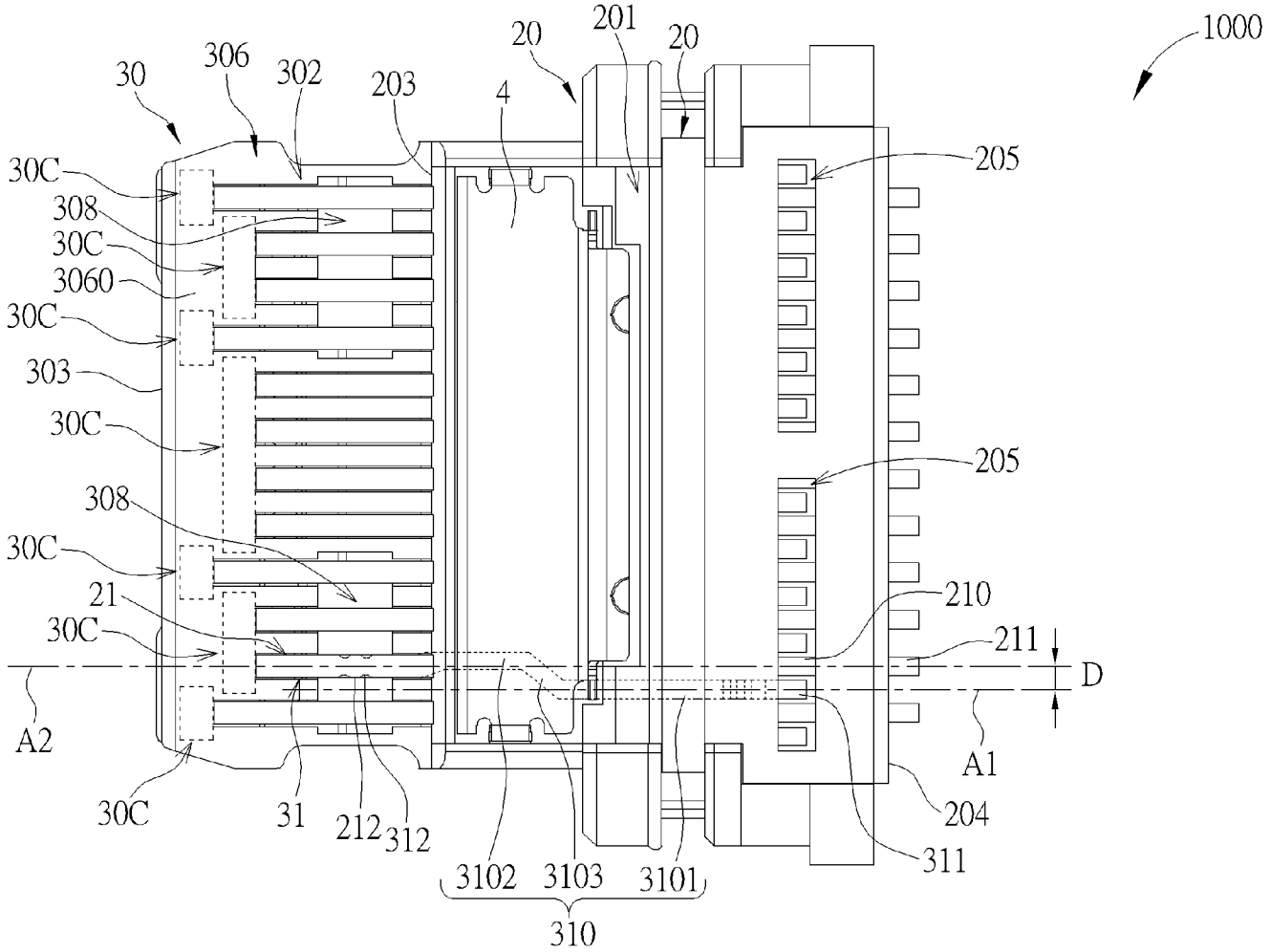
FIG. 4 is a top view of the receptacle connector according to the embodiment of the present invention.

Please refer to FIG. 4. FIG. 4 is a top view of the receptacle connector 1000 according to the embodiment of the present invention. In order to clearly illustrate, the shell 1 of the receptacle connector 1000 is omitted in FIG. 4. As shown in FIG. 4, a central axis A1 of the second soldering portion 311 of the second blanking contact 31 is spaced from a central axis A2 of the second contact portion 312 by an offset D, i.e., the central axis A1 of the second soldering portion 311 is not aligned with the central axis A2 of the second contact portion 312, while the first soldering portion 211 of the first blanking contact 21 is aligned with the first contact portion 212. As a result, when the first contact module 2 is assembled with the second contact module 3, the first contact portion 212 of the first blanking contact 21 is aligned with the second contact portion 312 of the second blanking contact 31. In the meanwhile, the structure that the central axis A1 of the second soldering portion 311 of is spaced from the central axis A2 of the second contact portion 312 by the offset D allows the second soldering portion 311 of the second blanking contact 31 to be located between the first soldering portion 211 of the two adjacent first blanking contacts 21.

In this embodiment, the second fixing portion 310 of the second blanking contact 31 includes a first straight section 3101, a second straight section 3102 and an inclined section 3103. The first straight section 3101 is extended along the central axis A1 of the second soldering portion 311, i.e., an orientation of the first straight section 3101 is parallel to an orientation of the second soldering portion 311. The second straight section 3102 is extended along the central axis A2 of the second contact portion 312, i.e., an orientation of the second straight section 3102 is parallel to an orientation of the second contact portion 312. The inclined section 3103 connects the first straight section 3101 and the second straight section 3102, and an orientation of the inclined section 3103 is inclined to the orientation of the first straight section 3101 and the orientation of the second straight section 3102. Structures of the second fixing portion 310 of the second blanking contact 31 are not limited to those illustrated in figures in this embodiment, and it depends on practical demands.

Figure 5:
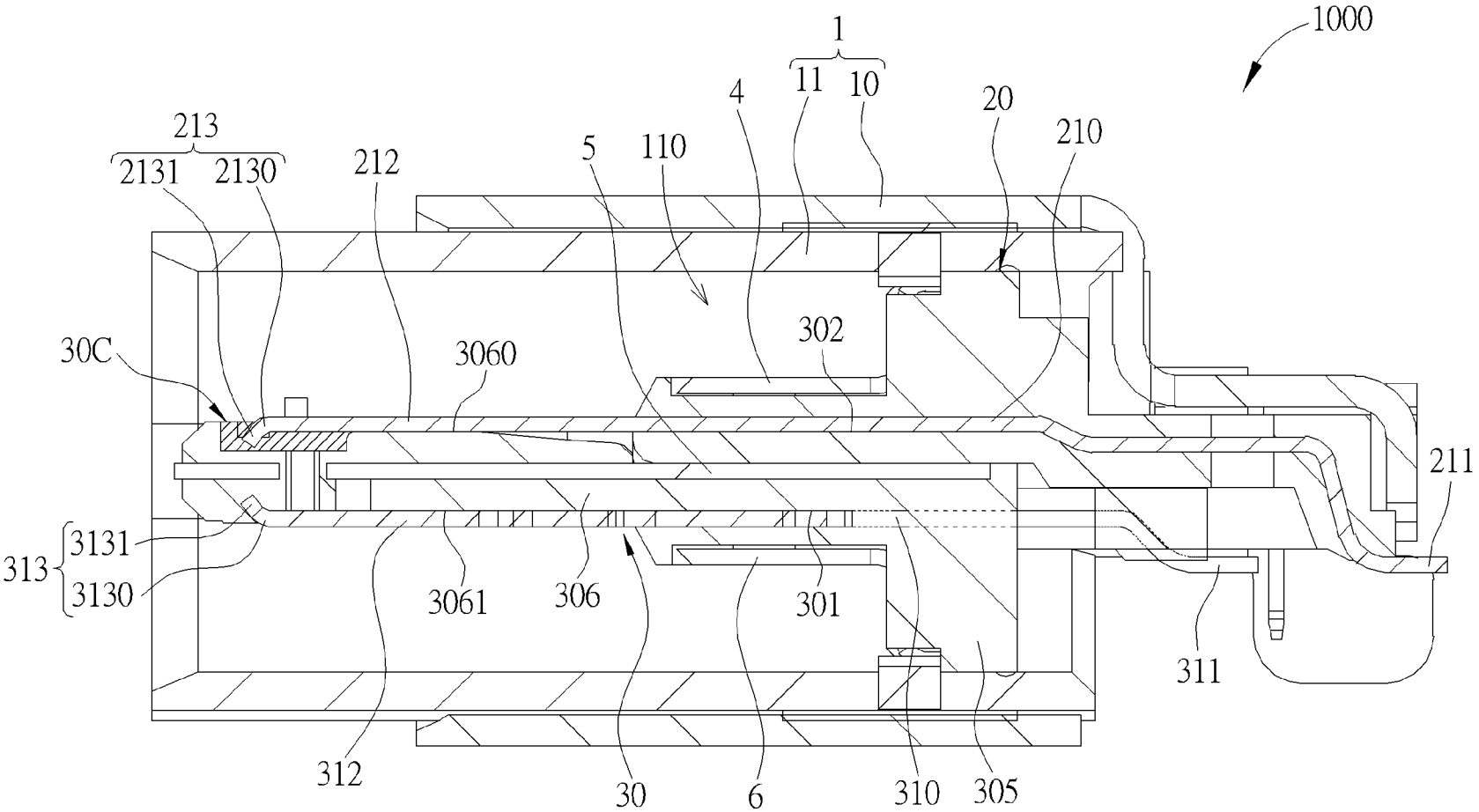
FIG. 5 is a sectional diagram of the receptacle connector according to the embodiment of the present invention.

Please refer to FIG. 5. FIG. 5 is a sectional diagram of the receptacle connector 1000 according to the embodiment of the present invention. As shown in FIG. 5, the second blanking contact 31 further includes a second combining portion 313, protruding from the second contact portion 312. When the second blanking contact 31 is formed on the second insulator 30 by insert molding, the second combining portion 313 is inserted into the second insulator outer surface 301 of the second insulator 30. Furthermore, the second combining portion 313 includes an second arc-shaped section 3130 and a second inserting section 3131. The second arc-shaped section 3130 is bent from the second contact portion 312. The second inserting section 3131 is extended from the second arc-shaped section 3130. When the second blanking contact 31 is formed on the second insulator 30 by insert molding, the second inserting section 3131 is inserted into the second insulator 30, such that the second combining portion 313 firms holds a wall body of the second insulator 30. Furthermore, the second arc-shaped section 3130 is exposed on the second insulator outer surface 301 of the second insulator 30, so as to guide a lower contacts of a plug connector to enter the second contact portion 312. In such a manner, it reduces a resisting force when the lower contacts enter the second contact portion 312, so as to prevent the second blanking contact 31 from deformation during mating process.

Figure 6:
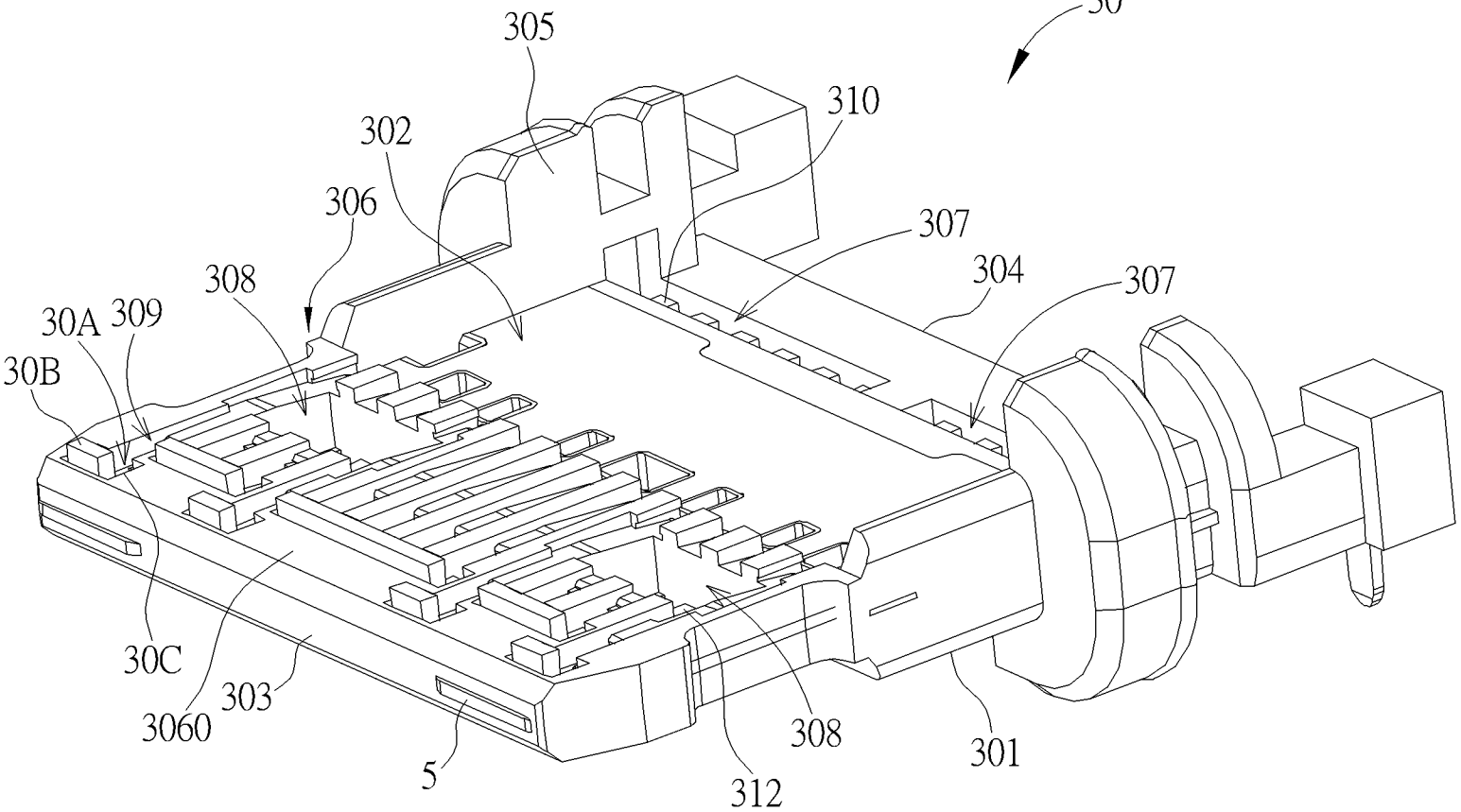
FIG. 6 is a diagram of a second insulator in an initial status according to the embodiment of the present invention.
Figure 7:
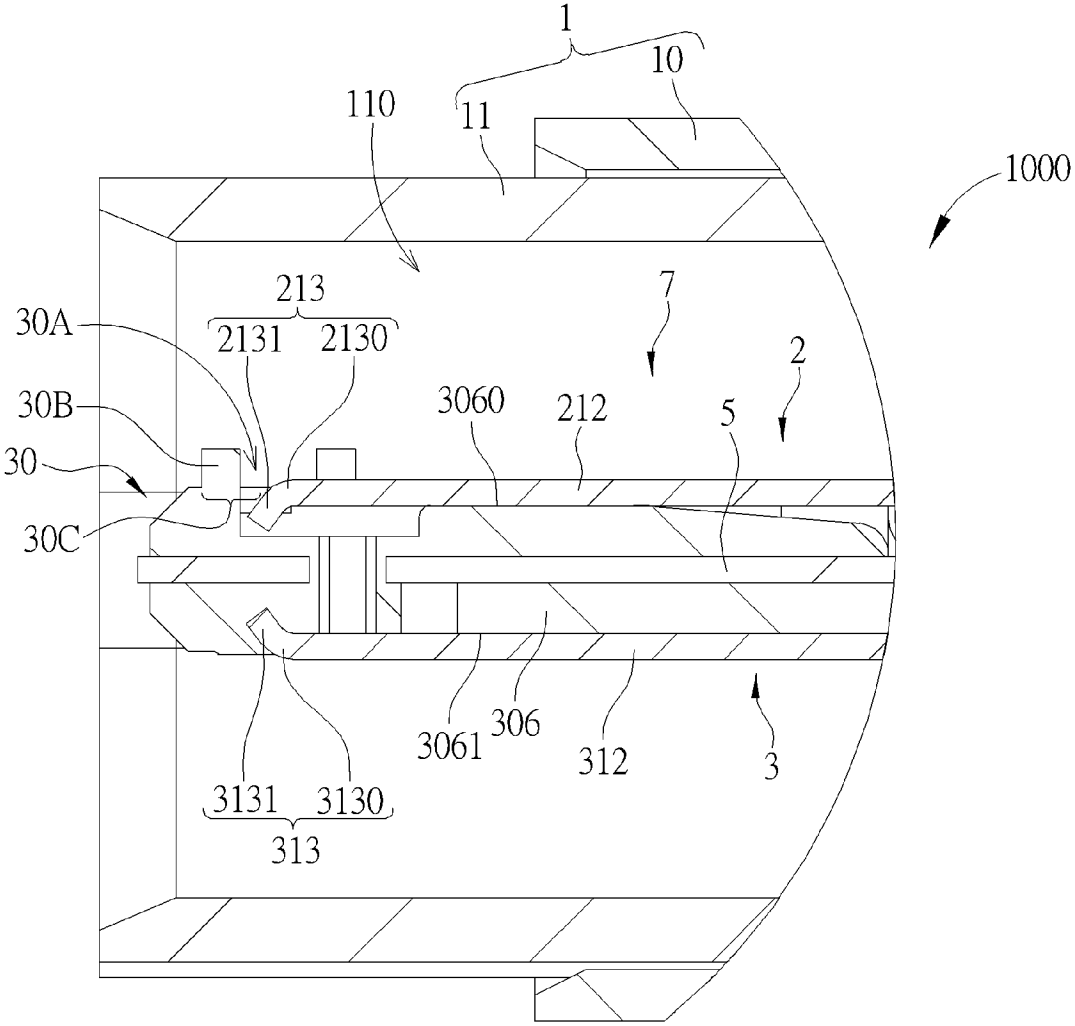
FIG. 7 is a sectional diagram illustrating that a first insulator is assembled with the second insulator in the initial status according to the embodiment of the present invention.
Figure 8:
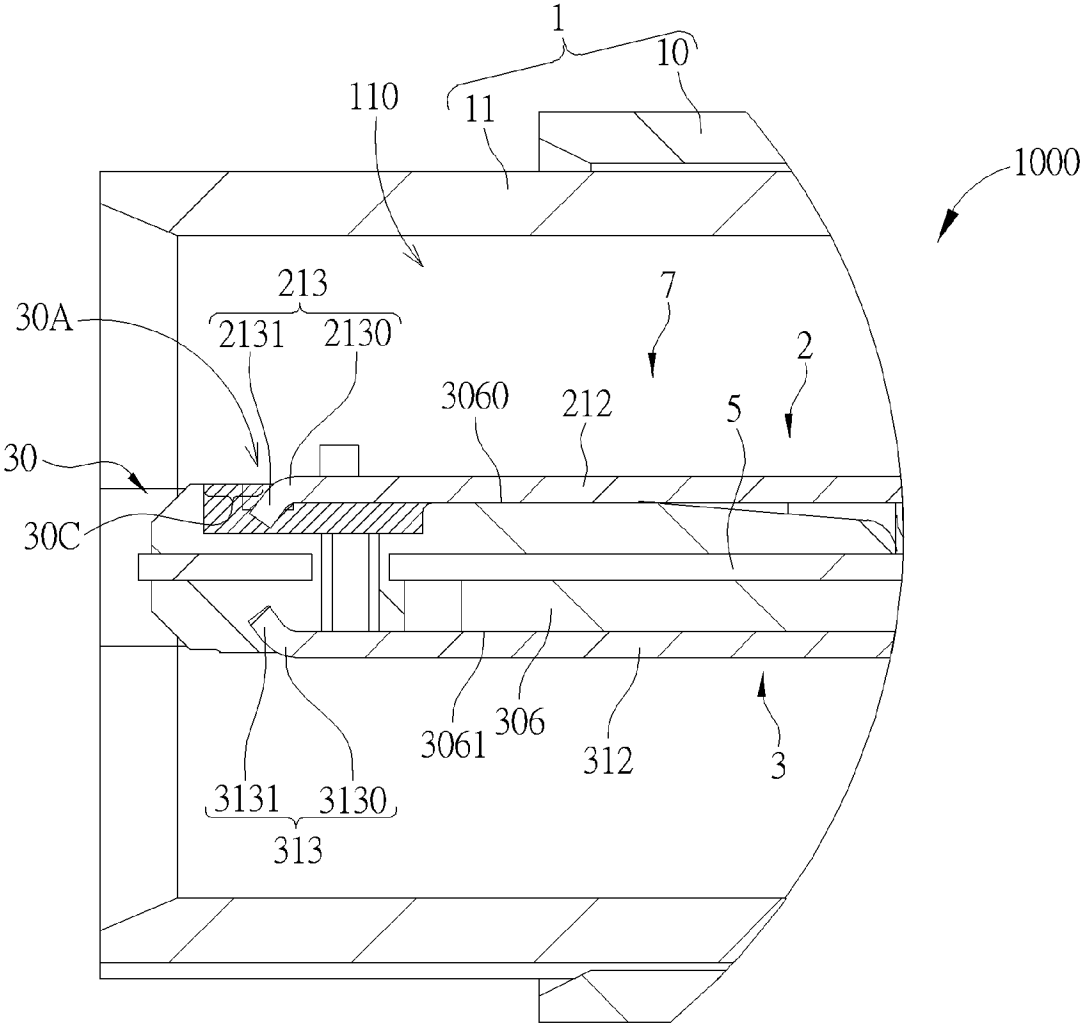
FIG. 8 is a sectional diagram illustrating that the first insulator is assembled with the second insulator in a welded status according to the embodiment of the present invention.

Please refer to FIG. 1, FIG. 2, FIG. 5 and FIG. 6 to FIG. 8. FIG. 6 is a diagram of the second insulator 30 in an initial status according to the embodiment of the present invention. FIG. 7 is a sectional diagram illustrating that the first insulator 10 is assembled with the second insulator 30 in the initial status according to the embodiment of the present invention. FIG. 8 is a sectional diagram illustrating that the first insulator 10 is assembled with the second insulator 30 in a welded status according to the embodiment of the present invention. As shown in FIG. 1, FIG. 2, FIG. 5 and FIG. 6 to FIG. 8, the first blanking contact 21 further includes a first combining portion 213 protruding from the first contact portion 212. Furthermore, the first combining portion 213 includes a first arc-shaped section 2130 and a first inserting portion 2131. The first arc-shaped section 2130 is bent from the first contact portion 212, and the first inserting portion 2131 is extended from the first arc-shaped section 2130. In this embodiment, when the first contact module 2 is assembled with the second contact module 3, the first inserting portion 2131 is inserted into the second insulator 30 in a hot-melting manner, such that the first fixing portion 213 firmly holds a wall body of the second insulator 3. Furthermore, the first arc-shaped section 2130 is exposed on the second insulator inner surface 302 of the second insulator 30, so as to guide an upper contacts of the plug connector to enter the first contact portion 212. In such a manner, it reduces a resisting force when the upper contacts enter the first contact portion 212, so as to prevent the first blanking contact 21 from deformation during mating process.

In practical application, when the second insulator 30 is in the initial status as shown in FIG. 2, FIG. 6 and FIG. 7, the second insulator 30 has a plurality of melting slots 30A and a plurality of melting posts 30B corresponding to the plurality of melting slots 30A, and the plurality of melting slots 30A and the plurality of melting posts 30B are corresponding to first fixing portions 213 of the first blanking contact 21. The plurality of melting posts 30B are next to the melting slots 30A, and each of the melting slots 30A communicate with the corresponding assembling slot 309, such that melting posts 30B are next to an end of the corresponding assembling slot 309. When the first contact module 2 is assembled with the second contact module 3, as shown in FIG. 7, the first inserting section 2131 of the first combining portion 213 of the first blanking contact 21 is disposed in the corresponding melting slot 30A. In the meanwhile, a hot-melting head (not shown in figures) is utilized for melting the melting posts 30B and pressing the melted melting posts 30B into the melting slots 30A, such that the melted melting posts 30B fills the melting slots 30A, so as to embed the first inserting section 2131 of the first fixing portion 213 into the second insulator 30.

After the melted melting posts 30B fills the melting slots 30A, the areas original occupied by the melting slots 30A are defined as first combining areas 30C, i.e., for perspective of product, the second insulator inner surface 302 has the plurality of first combining areas 30C, and the first inserting section 2131 of the first combining portion 213 of the first blanking contact 21 is inserted into the second insulator 30 via the first combining areas 30C. The way for the first inserting section 2131 of the first combining portion 213 of the present invention is not limited thereto. For example, the first inserting section 2131 of the first combining portion 213 can be inserted into the second insulator 30 by insert molding, and it depends on practical demands.

Figure 9:
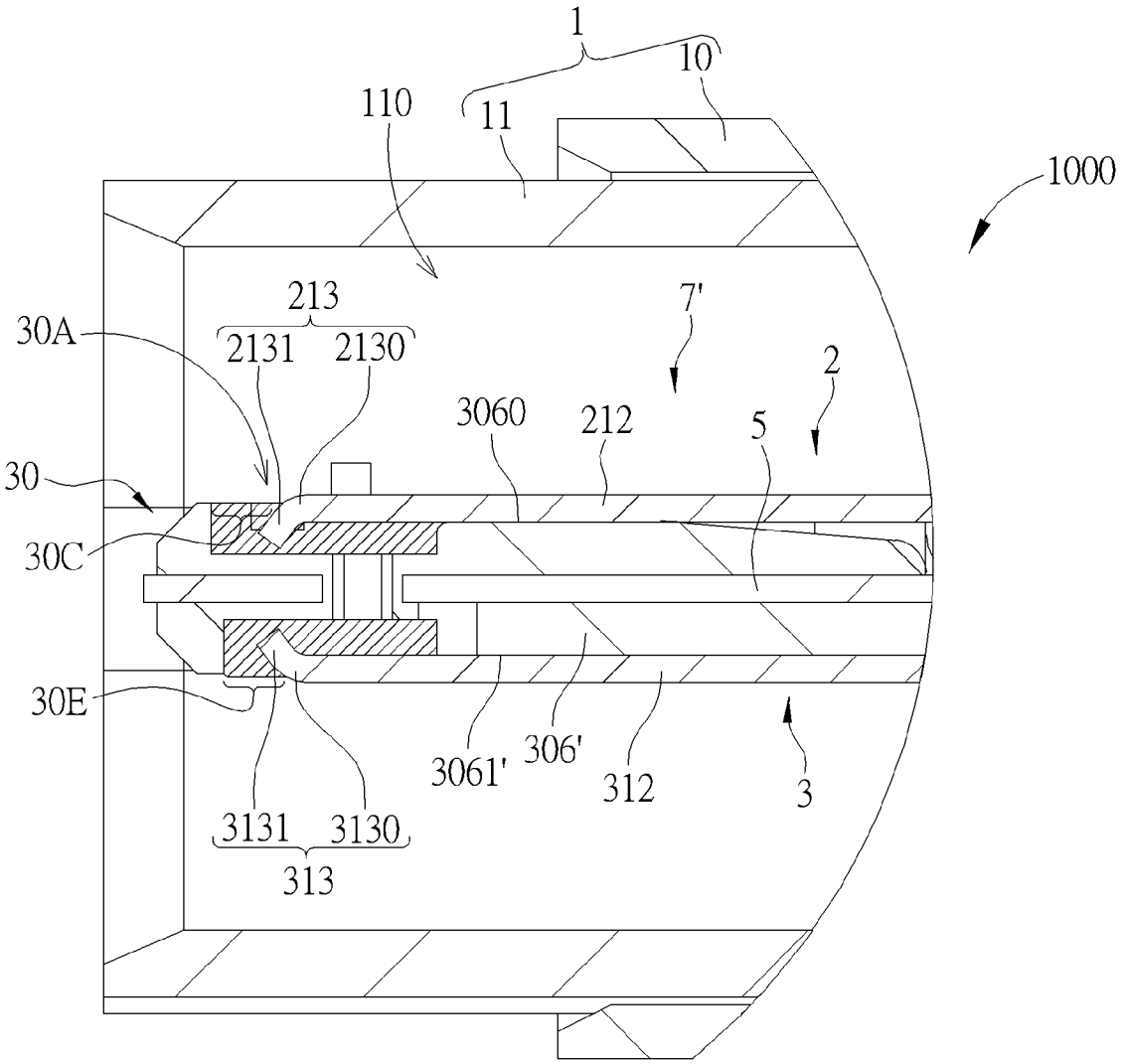
FIG. 9 is a sectional diagram of an insulating base according to another embodiment of the present invention.

Please refer to FIG. 9. FIG. 9 is a sectional diagram of an insulating base 7' according to another embodiment of the present invention. As shown in FIG. 9, the major difference between the insulating base 7' and the aforesaid insulating base 7 is that at least one second combining area 30E is further defined on a second surface 3061' of a tongue structure 306' of the insulating base 7'. The second combining portion 313 of the second blanking contact 31 is inserted into the at least one second combining area 30E of the insulating base 7', such that the second blanking contact 31 is combined with the tongue structure 306'. Components with denoted in this embodiment identical to those in the aforesaid embodiment have identical structures and functions, and further description is omitted herein for simplicity.

Figure 10:
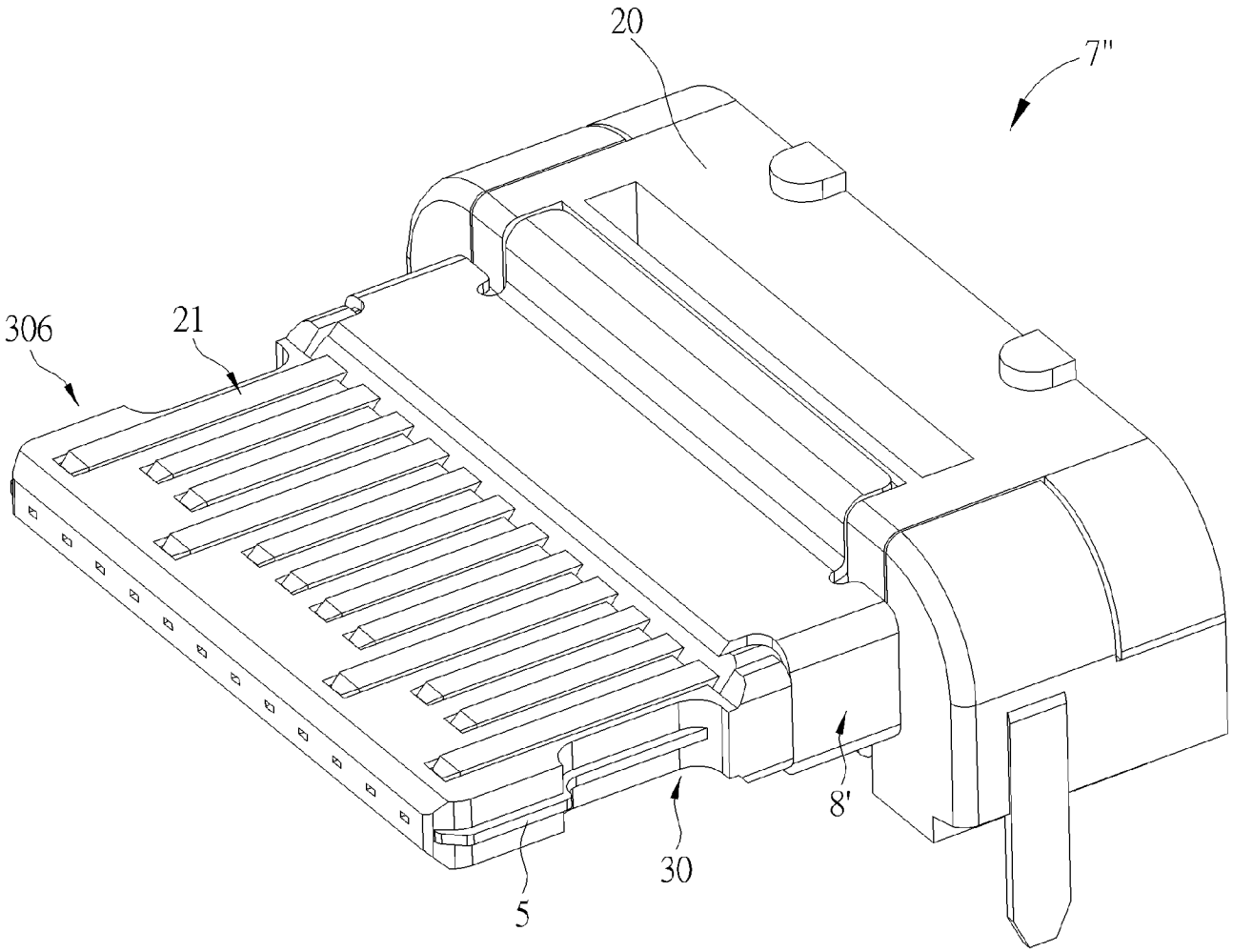
FIG. 10 is a diagram of an insulating base according to another embodiment of the present invention.

Please refer to FIG. 10. FIG. 10 is a diagram of an insulating base 7" according to another embodiment of the present invention. As shown in FIG. 10, the major difference between the insulating base 7" and the aforesaid insulating base 7 is that a conductive structure 8' of the insulating base 7" wraps the insulating base 7" and next to the first surface 3060 and the second surface 3061 of the tongue structure 306. Components with denoted in this embodiment identical to those in the aforesaid embodiment have identical structures and functions, and further description is omitted herein for simplicity.

Compared to the prior art, the present invention utilizes the first combining portion of the first blanking contact for being inserted into the second insulator inner surface, and the present invention further utilizes the second combining portion of the second blanking contact for being inserted into the second insulator outer surface. Accordingly, the first combining portion and the second combining portion firmly hold the wall body of the second insulator, so as to prevent the first blanking contact 21 from deformation during mating process.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A receptacle connector with capability of prevention of deformation of contacts during mating process, comprising:

a shell;

an insulating base disposed in the shell, the insulating base having an insulating base rear end and a tongue structure, the tongue structure having a first surface and a second surface, wherein at least one combining area is defined on the first surface, and the at least one combining area and the insulating base are made of electrical insulation material;

a first blanking contact set having a plurality of first blanking contacts, each of the first blanking contacts comprising:

a first fixing portion combined with the insulating base;

a first soldering portion protruding from the first fixing portion toward the insulating base rear end and stretching out of the insulating base rear end;

a first contact portion protruding from the first fixing portion toward the tongue structure and stretching out of the first surface; and a first combining portion protruding from the first contact portion and being inserted into the at least one combining area;

a conductive structure disposed on the insulating base; and a shielding member disposed in the tongue structure.

2. The receptacle connector of claim 1, wherein the first combining portion comprises:

a first arc-shaped section bent from the first contact portion and being exposed on the first surface of the tongue structure; and a first inserting section extending from the first arc-shaped section and being inserted into the tongue structure via the at least one combining area.

3. The receptacle connector of claim 1, wherein the insulating base comprises a first insulator and a second insulator combined with the first insulator.

4. The receptacle connector of claim 3, wherein the first insulator is disposed inside the shell, the first insulator has a first insulator outer surface, a first insulator inner surface, a first insulator front end and a first insulator rear end, the first fixing portion is combined with the first insulator, the second insulator is disposed inside the shell and assembled with the first insulator, the second insulator has a second insulator outer surface, a second insulator inner surface, a second insulator front end and a second insulator rear end, when the second insulator is assembled with the first insulator, the first insulator rear end and the second insulator rear end cooperatively define the insulating base rear end, and the first insulator inner surface abuts against the second insulator inner surface, wherein the second insulator stretches out of the tongue structure.

5. The receptacle connector of claim 4, wherein at least one hollow area is formed on the first insulator, the at least one hollow area opens from the first insulator outer surface to the first insulator inner surface, the first fixing portion is disposed through the at least one hollow area, such that a portion of the first fixing portion is exposed on the first surface and the second surface.

6. The receptacle connector of claim 1, further comprising:

a second blanking contact set having a plurality of second blanking contacts, each of the second blanking contacts comprising:

a second fixing portion combined with the insulating base;

a second soldering portion protruding from the second fixing portion toward the insulating base rear end and stretching out of the insulating base rear end;

a second contact portion protruding from the second fixing portion toward the tongue structure and stretching out of the second surface; and a second combining portion protruding from the second contact portion and being inserted into the tongue structure.

7. The receptacle connector of claim 6, wherein the second combining portion comprises:

a second arc-shaped section bent from the second contact portion and being exposed on the second surface; and a second inserting section extending from the second arc-shaped section and being inserted into the tongue structure.

8. The receptacle connector of claim 6, wherein a plurality of first assembling slots and a plurality of second assembling slots are respectively formed on the first surface and the second surface, the first contact portion of each of the first blanking contacts is installed in the corresponding first assembling slot, and an end of each of the first assembling slots is next to the at least one combining area, the second contact portion of each of the second blanking contacts is installed in the corresponding second assembling slot.

9. The receptacle connector of claim 4, wherein at least one first through hole area is formed on the second insulator, the at least one first through hole area opens from the second insulator outer surface and the second insulator inner surface, the second fixing portion is disposed through the at least one first through hole area, such that a portion of the second fixing portion is exposed on the second insulator outer surface and the second insulator inner surface.

10. The receptacle connector of claim 4, wherein at least one second through hole area is formed on the second insulator, the at least one second through hole area opens from the second insulator outer surface and the second insulator inner surface, the second contact portion is disposed through the at least one second through hole area, such that a portion of the second contact portion is exposed on the second insulator outer surface and the second insulator inner surface.

11. The receptacle connector of claim 6, wherein a central axis of the second soldering portion is spaced from a central axis of the second contact portion by an offset, such that the second soldering portion is located between the two adjacent first soldering portions, and the second fixing portion comprises:

a first straight section extending along the central axis of the second soldering portion;

a second straight section extending along the central axis of the second contact portion; and an inclined section connecting the first straight section and the second straight section.

12. The receptacle connector of claim 6, wherein each of the first blanking contact set and the second blanking contact set comprises at least two pairs of differential signal contacts, the at least two pairs of differential signal contacts of the first blanking contact set are symmetrical to the at least two pairs of differential signal contacts of the second blanking contact set about a front-rear direction of the electrical receptacle connector and coincides with the at least two pairs of differential signal contacts of the second blanking contact set after rotation by 180 degrees.

13. The receptacle connector of claim 1, wherein the conductive structure comprises a first conducting member and a second conducting member, the first conducting member is disposed on the insulating base and located next to the first surface, and the second conducting member is disposed on the insulating base and located next to the second surface.

14. The receptacle connector of claim 1, wherein the conductive structure wraps the insulating base and next to the first surface and the second surface.

15. A receptacle connector with capability of prevention of deformation of contacts during mating process, comprising:

a shell;

an insulating base disposed in the shell, the insulating base having an insulating base rear end and a tongue structure extending therefrom, the tongue structure having a first surface and a second surface, wherein at least one first combining area is defined on the first surface, at least one second combining area is defined on the second surface, and the at least one first combining area, the at least one second combining area and the insulating base are made of electrical insulation material;

a first blanking contact set having a plurality of first blanking contacts, each of the first blanking contacts comprising:

a first fixing portion combined with the insulating base;

a first soldering portion protruding from the first fixing portion toward the insulating base rear end and stretching out of the insulating base rear end;

a first contact portion protruding from the first fixing portion toward the tongue structure and stretching out of the first surface;

a first combining portion protruding from the first contact portion and being inserted into the at least one combining area;

a second blanking contact set having a plurality of second blanking contacts, each of the second blanking contacts comprising:

a second fixing portion combined with the insulating base;

a second soldering portion protruding from the second fixing portion toward the insulating base rear end and stretching out of the insulating base rear end;

a second contact portion protruding from the second fixing portion toward the tongue structure and stretching out of the first surface;

a first combining portion protruding from the first contact portion and being inserted into the at least one combining area;

a conductive structure disposed on the insulating base; and a shielding member disposed in the tongue structure.

* * * * *